United States Patent [19]

Canell et al.

[11] 4,005,268

[45] Jan. 25, 1977

[54] SOLID STATE ECHO PRODUCING SYSTEM

[75] Inventors: George Canell, Chicago; Larry A. Schotz, Arlington Heights, both of Ill.

[73] Assignee: Lynn Industries, Chicago, Ill.

[22] Filed: Apr. 7, 1975

[21] Appl. No.: 565,802

[52] U.S. Cl. ..... 179/1 J

[51] Int. Cl.[2] ..... H04R 3/00

[58] Field of Search ..... 179/1 J

[56] References Cited

UNITED STATES PATENTS

| | | | |
|---|---|---|---|
| 3,681,531 | 8/1972 | Burkhard | 179/1 J |
| 3,749,837 | 7/1973 | Doryetz | 179/1 J |
| 3,881,057 | 4/1975 | Adachi | 179/1 J |

*Primary Examiner*—Kathleen H. Claffy
*Assistant Examiner*—E. S. Kemeny

[57] ABSTRACT

A solid state electronic system for producing a variable time delayed echo signal from a source of electro-audio input signals including circuitry for reducing noise. For low level signal operation, the system has means for varying the internal reference to thereby require twice as many digital bits to correspond to a given analog signal input amplitude thereby doubling the resolution when operating in said low signal mode.

4 Claims, 1 Drawing Figure

SOLID STATE ECHO PRODUCING SYSTEM

BACKGROUND OF THE INVENTION

This invention relates in general to an echo producing or reverberation system in which an audio input can be reproduced and delayed according to the desires of the listener and, in particular, to an electronic system for artificially producing reverberations or echoes of varying time interval and frequency of occurrence from any electro-audio signal source.

More specifically, this invention relates to a solid state reverberation or echo producing system adapted to be coupled to any electronic audio signal source for reproducing a delayed secondary signal echoing the primary input signal in accordance with any desired delay time or repetition of the echo.

In the entertainment field it is sometimes desirable to enhance not only vocal and instrumental recordings, but rhythm patterns through the use of echo effects such as produced in an echo chamber. This echo reproduction has not only been used by many recording artists and groups, but in some instances has been used to such an extent that it has become the style of certain entertainers. Such echo effects have normally been produced by recording the selection in an echo chamber, and it is many times desirable to enhance existing recordings by re-recording the selections with an echo type background or to listen to the record with a selective echo effect.

Various electrical sound delaying devices have been developed in order to provide such a stereophonic sound effect or an echo effect to music or speech simulating a large auditorium, or the effect produced by recording in an "echo chamber". Such systems have utilized a tape or wire recorder coupled into the speaker circuit from a microphone and in this manner, as the audio signals are passed from the microphone, they are coupled to a recording head which records the signals onto a storage medium which is running in an endless loop. As the primary signal is recorded onto the recording medium, the medium advances and at a predetermined time the signals are picked up by a playback head which couples the signals to the speaker, thereby producing a time delayed reproduction or echo of the original audio input. While such systems have been utilized successfully in certain applications, they are limited by such things as difficulty encountered when attempting to adjust the delay or echo time due to the physical and electronic constraints of the system and cannot reproduce or provide an echo effect for signals less than a predetermined time period. In addition, such systems lose reproduction quality by requiring that the signal be recorded onto an intermediate storage medium.

One of these problems encountered with the echo producing systems utilizing a tape recorder or magnetic recording medium is that when the recording head is placed close to the readback or playback head, the relatively large current amplitudes of the recording head produce a leakage flux which is intercepted by the readback or playback head coil and appears as a noise signal. If the recording head is placed too closely in physical proximity to the playback head, the noise signals are so great that the echo reproduction is unacceptable. Therefore, such systems cannot be utilized closer than a predetermined minimum physical spacing between the units. Since the distance between the recording head and the playback head defines the time delay or the echo time, the only type of echoes which may be satisfactorily produced on such a system are those wherein the desired time delay period is greater than the minimum predetermined spacing between the recording and the playback head is taking into consideration the speed at which the tape is moved between the two heads. Shielding has been attempted to minimize this noise problem, but greatly increases the cost of the echo system. While shielding has been found to alter the limits of the problem, it does not provide a satisfactory solution.

In addition to the timing and "noise" problem, it has been found that the endless loop of recording medium utilized to provide the buffer for the delayed or echo signal is difficult to load or reload. In order to utilize both sides of the recording medium, the recording medium must be spiral-wound in a loop of a predetermined length with an exact number of loop turns to operate reasonably smoothly. Therefore, only a relatively small number of loop turns can be used. If the tape is shortened or lengthened, as in making a repair splice, the tape cannot be adjusted to the loop change and damaging binding action results. One attempt to solve this problem has been through the use of a spiral-wound loop body wherein automatic self-adjusting take-up mechanisms are used which, obviously, adds to the cost of such a system and have not proven to be entirely satisfactory.

A further problem encountered with such electromechanical systems is the cost and maintenance of the recording and playback heads. Since these systems utilize an intermediate storage or buffer medium, such as the recording tape, the wear on the tape and the problem of tape breakage create additional problems which lend themselves to unsatisfactory operation of these prior art systems.

SUMMARY OF THE INVENTION

It is, therefore, an object of this invention to impart an echo effect to electro-audio input signals.

Another object of this invention is to reverberate audio signals from any type of electro-audio signal input source.

Still another object of this invention is to improve the quality of echo effect systems.

These and other objects are attained in accordance with the present invention wherein there is provided a solid state electronic system for producing a variable time delayed secondary echo signal to provide a reverberation effect to a source of electro-audio input signals which may be readily adjusted in accordance with the listener's preference both as to time delay and frequency of the echoed output.

DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein.

DESCRIPTION OF THE PREFERRED EMBODIMENT

Figure 1:
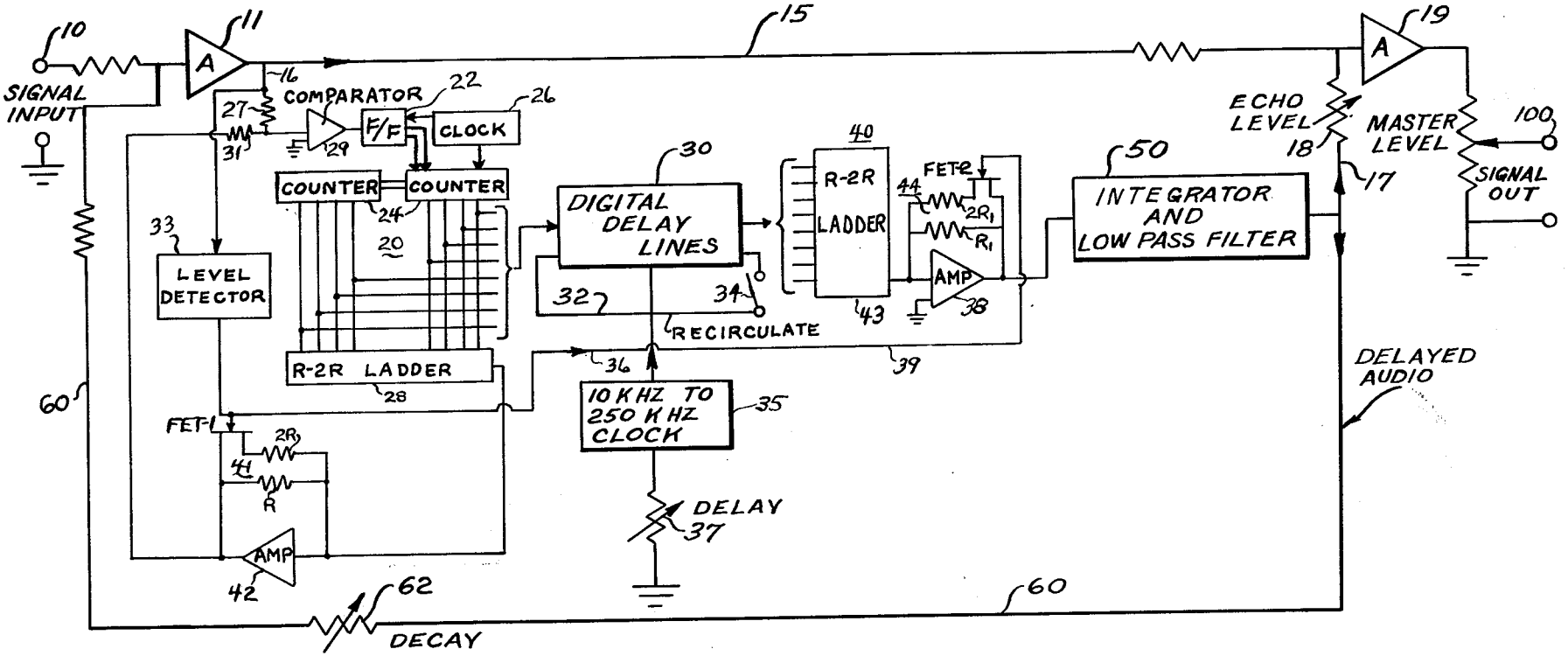
FIG. 1 is an electrical schematic block diagram of the reverberation system showing an electro-audio input signal source coupling a primary signal and a secondary or echo signal, produced through various electronic components, to a suitable speaker.

Referring to FIG. 1, an electro-audio input signal is received at input terminal 10 and coupled to input operational amplifier 11 which amplifies the signal to a predetermined level. The output from the amplifier 11 is connected to transmission lines 15 and 16 which produce a primary and a secondary or echo signal, respectfully. The primary signal on transmission line 15 is coupled to the output amplifier 19 which is connected to an output terminal 100.

The echo of the primary signal is produced through transmission line 16 which is connected to the output of input amplifier 11. The output signal from the amplifier 11 is coupled through transmission line 16 of an analog to digital converter generally labeled 20 and being of known counter type, whereat the signal is converted from analog to digital format. The analog to digital converter 20 will be described in more detail hereinbelow.

The audio signals which have been converted to a digital format, by converter 20 are then clocked out from the analog to digital converter 20 into and through the digital delay lines 30 — which comprises a series of shift registers — at a rate determined by clock 35. Although the clock 35 may produce a pulse or count rate of any interval, for convenience of illustration a preferred embodiment shows the count rate producing a pulse count of 10KHz to 250KHz as determined by variable resistor 37. The setting of variable resistor 37 controls the rate of clock pulses and, therefore, the rate at which the analog or audio signal is passed through the digital delay lines 30. The output of the digital delay lines 30 is coupled as an input to a digital to analog converter 40 being of a known resistive ladder type, whereat the signals clocked out of the digital delay line are reconverted from digital format back to an analog or audio signal. The details of the digital to analog converter 40 will be described in more detail hereinbelow.

The output from the digital to analog converter 40 is then coupled to an integrator and low pass filter 50 whereat the analog signal is integrated and filtered to remove noise and high frequency components. The time delayed audio analog signal from the integrator 50 is then coupled through line 17 to the input of output amplifier 19 whereat it is summed with the primary or non-delayed signal from transmission line 15. A variable resistor 18 in line 17 may be adjusted to provide the desired level of the echoed or secondary audio signal.

In order to continue the echoing effect of the secondary or echo signal, the output from the integrator and filter 50 is also coupled through line 60 to the input of input amplifier 11. In this manner as the initial secondary signal is produced and coupled to the output amplifier 19 to produce the initial echoed signal, the output is also coupled to the input of amplifier 11 to produce a reduced primary signal which is then transmitted through transmission lines 15 and 16 to produce another echo cycle. In order to continue the delay or echoing effect, a variable resistor 62 is coupled into line 60 such that the initial secondary or echo signal coupled into the input amplifier 11 will be reduced to a level less than that of the prior secondary signal coupled through line 17 into the input of output amplifier 19. In this manner the next signal cycle coupled to input amplifier 11 will be reduced to a level determined by variable resistor 62 such that the primary output from the input amplifier 11 transmitted through line 15 to the output amplifier 19 will be less than the prior echo signal coupled through line 17.

If it is desired to repeat the same signal, for example in certain rhythm and other instrumental effects, a recirculation line 32 is provided. In that event switch 34 is closed and the output of the digital delay lines, or series of shift registers 30, is recycled as is known in the art as an input to the digital delay line to continually recycle the digital data in accordance with the clock rate provided by clock 35.

The variable resistors 18 and 62 can be adjusted to produce varying differences in the level or amplitude of the echo signal effect and the resistor 37 can be adjusted to produce varying time delays between echoed signals. In addition, the closing of switch 34 will allow a particular echo signal to be repetitively reproduced enabling a user to create many and varied echo patterns from any type of audio signal input received by input terminal 10. Also, if new audio input signals are continuously received at input terminal 10, the echoes may even be superimposed one upon the other.

Heretofore a problem or disadvantage of converting from analog signals to digital data and reconverting the digital to analog signal is losing the dynamic range of the analog signal. Heretofore to maintain a reasonable dynamic range resort is made to using many bits in the analog to digital and digital to analog in the converters for low level resolution. This in turn, makes the cost of such converters prohibitive for many consumer oriented products. Another problem in such converters is low level signal distortion. For example, assume an eight bit analog to digital converter has a dynamic range of 48 db; however, as the analog signal decreases in level, less and less bits remain to track the incoming signal, thereby resulting in a very distorted signal. The circuitry of the invention not only solves the distortion problem but also increases or expands the dynamic range to greater than 70 db.

Refer again to FIG. 1 divider and more specifically to the details of the analog to digital converter 20 and the digital to analog converter 40. The audio input of amplifier 11 in the form of an analog signal is also coupled through line 16 and series resistor 27 to the analog to digital converter 20 which is of the counter-feedback type. Converter 20 includes a voltage comparator 29 which couples through a flip flop or mono-stable multivibrator 22 to a pair of binary decade up-down counters 24. A clock 26 is coupled to flip flop 22 and counters 24 to determine the rate at which the flip flop 22 and counters 24 operate. As is known, in the analog to digital converter shown, the comparator 29 is arranged to provide a signal through flip flop 22 to cause the binary counters 24 to count up or down dependent on the amplitude of the incoming signal. The digital output of the counters 24 is then coupled to the delay lines 30.

The output of the counters 24 is also coupled to an associated R-2R resistance ladder 28, to convert the digital data from counters 24 to an analog signal, to provide a feedback signal through operational amplifier 42 and resistor 31 back to the input of comparator 29.

The output from amplifier 11 is also coupled directly to an amplitude level detector 33. Note that converter 20 provides a conventional eight bit input to the delay lines 30 as indicated in the drawing. As further explained hereinbelow detector 33 selectively provides an output to energize an electronic switch, which in the embodiment shown, is in the form of a field effect transistor designated as FET-1. More specifically, the output of detector 33 is coupled to the gate electrode of transistor FET-1. The drain electrode of transistor FET-1 is coupled through a resistor 2R to the input side of an operational amplifier 42, and the source electrode of transistor FET-1 is connected to the output side of amplifier 42. A resistor $R_1$ is connected in parallel across amplifier 42. Resistors R and 2R are equal; that is, resistor 2R has the same resistance value as resistor R. Resistors R and 2R of transistor FET-1 function as a signal amplitude divider 41 and provide a range doubling function as will be explained.

The output of level detector 33 is also connected through a lead 36, and line 39 to a second electronic switch FET-2, comprising a second field effect transistor, and more particularly to the gate electrode thereof. The drain electrode of FET-2 is connected through a resistor $2R_1$ to the input side of an amplifier 38, and the source electrode of FET-2 is connected to the output side of amplifier 38. A resistor $R_1$ is connected in parallel across the amplifier 38. The resistance values of resistors $R_1$ and $2R_1$ correspond to the values of resistors R and 2R, and in effect comprise a matching network 44 for the signal amplitude divider or range doubler 41.

In operation, when the output from amplifier 11 is above a selected level, a signal is provided through the analog to digital converter 20 to the digital delay lines 30. The output from digital delay lines 30 is coupled as an eight bit output to digital to analog converter 40 which comprises a second resistance ladder 43, similar to ladder 28 and thence through operation amplifier 38 to an integrator and low pass filter 50 to provide a delayed analog signal in the audio range to transmission line 60 as described above.

If, however, the output from amplifier 11 is below a selected level, the level detector 33 provides an output to turn on the FET-1 transistor switch to connect the range doubler 41 (resistors R and 2R) in the circuit to divide the amplitude of the analog signal output from the ladder 28 by two and couples the divided-by-two signal through amplifier 42 to comparator 29. The range doubler 41 thus effectively divides the internal reference by two, and therefore it takes twice as many bits to equal a given analog signal amplitude, thereby doubling the resolution when operating in this mode; in other words, the counter must count twice as high in response to an analog signal of a given amplitude.

Note that in the embodiment shown, resistor 2R of FET-1 is of the same resistance value as resistor R of FET-1 to thereby effectively divide the amplitude of the analog signal by two; however, other multiples or ratios of resistances could be utilized. The resistances and ratios of resistors $R_1$ and $2R_1$ should correspond to those of resistors R and 2R.

In the embodiment shown, resistance ladders 28 and 40 are employed, however, so-called binary divider ladders would be used in lieu thereof.

Further, in the embodiment shown, the reference detector 33 is set to detect signals from amplifier 11 which are at a selected −30 db below the maximum input. As described above, when the signal is below the selected level, level detector 33 turns on switch or transistor FET-1 and couples the resistance divider functioning as a range doubler 41 in the feedback loop of comparator 29 to double the resolution of the system.

Concurrently, as transistor FET-1 is turned on, the signal from level detector 33 is also coupled through line 36 to turn on the transistor switch FET-2 in the feedback loop of the digital to analog converter 40 so that converter 40 tracks the analog to digital converter 20 and retains the same relative reference position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electronic signal echo producing system for producing and coupling a delayed secondary signal echoing a primary audio signal comprising, in combination, input means for receiving audio signals as an analog signal, output means, transmission means for transmitting the input signals received by said input means as a primary audio signal to said output means, analog to digital signal converting means coupled to said transmission means for producing from the input signal transmitted thereby a secondary signal in digital data format, signal delay means coupled to said signal converting means for receiving the secondary input signal in digital format and selectively actuable to delay the transmission of the digital format signals, first digital to analog signal converting means coupled to said signal delay means for converting the secondary signals transmitted thereto into analog format, means for combining the primary audio signal and the secondary signal in analog format at the output means, second digital to analog signal converting means for converting the digital data into an analog reference signal, and feedback circuit means for coupling said analog reference signal back to the input of said first analog to digital converting means, electronic switch means, signal amplitude divider means electronically connectible by said switch means into said feedback circuit means, level detector means connected to said input means and operable in response to a selected signal level to cause said switch means to connect said divider means into said feedback circuit means causing the amplitude of said reference signal to be divided to thereby improve the resolution of said system when operating at low signal levels.

2. An apparatus as in claim 1 wherein said signal amplitude divider means comprises resistive means.

3. An apparatus as in claim 1 further including second electronic switch means and second divider means, said second switch means being connected to said level detector said second divider means being electronically connectible by said second switch means in the output terminal of such first digital to analog converting means concurrently as said first divider means is connected in said feedback circuit to thereby obtain proper tracking of the signal from said first digital to analog converting means.

4. An apparatus as in claim 3 wherein said second divider means comprises resistive means.

* * * * *